United States Patent [19]

Colucci

[11] Patent Number: 4,962,927

[45] Date of Patent: Oct. 16, 1990

[54] PUTTER HEAD

[76] Inventor: Nicholas Colucci, 67 Bache Ave., New York, N.Y. 10306

[21] Appl. No.: 480,309

[22] Filed: Feb. 15, 1990

[51] Int. Cl.[5] ..... A63B 53/00

[52] U.S. Cl. ..... 273/162 E; 273/164; 273/167 R; 273/167 H; 273/169

[58] Field of Search ..... 273/162 E, 183 D, 194 A, 273/164, 169, 170, 171, 167 A, 167 E, 167 F, 167 H, 167 K, 173, 174, 163 R

[56] References Cited

U.S. PATENT DOCUMENTS 2,503,506 4/1950 Miller ..... 273/183 D
2,621,044 12/1952 Sloan ..... 273/194 A
3,300,241 1/1967 Eberwein et al. ..... 273/162 E
3,374,027 3/1968 Jacobs ..... 273/162 E

*Primary Examiner*—George J. Marlo

[57] ABSTRACT

A golf putter includes a horizontal flange extending rearward from the upper edge of a blade having a front face for striking golf balls. A pair of spaced apart narrow walls also extend rearward from the rear surface of the striking face and define an open space into which a golf ball may be wedged and retrieved. The flange and narrow walls provide weight centered on the blade's sweet spot. The upper surface of the flange may be provided with a sighting line to line up the putt with a target. The lower edges of the blade and vertical walls provide reduced resistance from grass during putting.

2 Claims, 1 Drawing Sheet

PUTTER HEAD

BACKGROUND OF THE INVENTION

1. Field of the Invention

The putter head is a part of a golf club called a putter which consists of a head, shaft and grip. This invention is the head.

2. Description of the Prior Art

Putter heads made with flanges and sighting aids. Most of the soles are wide which makes it difficult to hit out of deep grass.

The sighting aids are short, the weight of the flanges are not positioned directly behind the hitting area and do not provide substantial weight in the flange to produce inertial energy. Putter flangers are not made with sides that are spaced to pick up a golf ball.

SUMMARY OF THE INVENTION

The object of my invention is to provide a putter that is balanced, easy to line up, hit out of deep grass, easy to control and can pick up a golf ball out of a putting cup.

This putter head is different due to the combination of the position, weight distribution, length and shape of the flange, the thin sole, rounded sole, one piece solid cast and is able to lift a golf ball. The center of the flange is positioned in the center of the toe 19 and heel 20 of the blade. The flat flange is an extension of the top of the blade to provide clearance to allow the golfer to hit the ball out of deep grass from off the green which is often necessary.

The distance between the inside of the sides 7 of the putter head is slightly smaller than a golf ball. When the putter head is placed over a golf ball and pressure is applied downward, the ball will become wedged between the sides 7. This wedging action can be used to lift the ball off the green and out of water. The putter head is small enough to enter the putting hole cup to retrieve a golf ball.

The bottom of the sides 7 of the flange is parallel to the top of the flange. This supports the flange and keeps the flange parallel to the ground while addressing the ball to line up the sighting line with the target.

The sides 7 are extensions of the blade 9 and flange of the putter.

The distance from the top of the flange 18 to the bottom of the sides 7 is the same as the height of the face 16.

In FIG. 2 the sides 10 of the flange and the line in the center of the flange are perpendicular to the face of the blade. The line in the center of the flange and the weight are centered with the sweet spot.

The weight distribution in the flange and sides are a major factor to produce inertial energy on the down swing to help the putter to go through the hitting area. With the weight of the flange and sides 7 centered directly behind the hitting area, it provides a solid feel and directional control.

The narrow rounded sole and sides are designed to reduce the resistance from the grass.

The narrow blade 9 allows most of the weight of the putter head to be placed in the flange and sides.

DESCRIPTION OF THE PREFERRED EMBODIMENT

Figure 2:
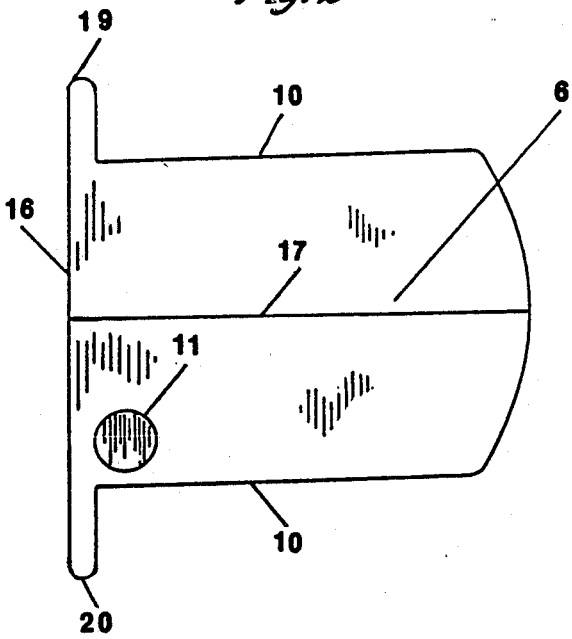
FIG. 2 is a top view of the putter head, showing the centering, length and width of the flange with relation to the face 16. The hole 11 is for a shaft.

Flange 6 FIG. 2 is scientifically balanced, so that the center of the flange is on center with the sweet spot. (part of the face where the ball should be struck for the best feel and consistency).

The width and weigth of the flange and the sides are designed to widen the sweet spot. The weight distribution of the flange and sides are to produce inertial energy and to reduce the twist of the blade on an off hit.

The length of the flange from the face to the back of the flange is slightly shorter than the heel 20 to the toe 19 of the face to conform with the United States Golf Association Rules.

The height of the flange is to allow a ball to become wedged between the sides 7 and is positioned to place the weight directly behind the center of the hitting area for directional control and to make it easier to putt from off the green in deeper grass.

The line 17 on the center of the flange is a sighting line perpendicular to the face, indicates the sweet spot and to line up the putt with a target.

Figure 1:
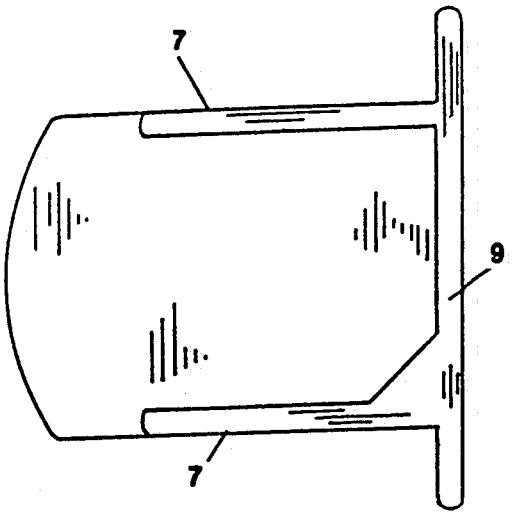
FIG. 1 is a bottom view showing the width of the blade 9, sides 7, the length and distance between the sides 7.

The distance between the inside of the sides 7 as shown in FIG. 1 is positioned to allow a ball to be wedged between them. The rounded bottom is to allow the sides to slip through the grass.

The sides 10 of the flange 6 are perpendicular to the face for line up, as shown in FIG. 2.

Figure 4:
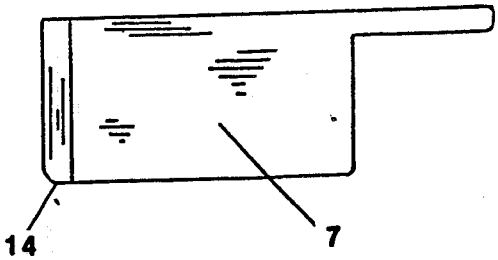
FIG. 4 is a side view of the putter head, showing the position, height, thickness of the flange, face 16, and the narrow rounded sole 14. The shape and length of the side 7. The flat of the putter head 18.
Figure 5:
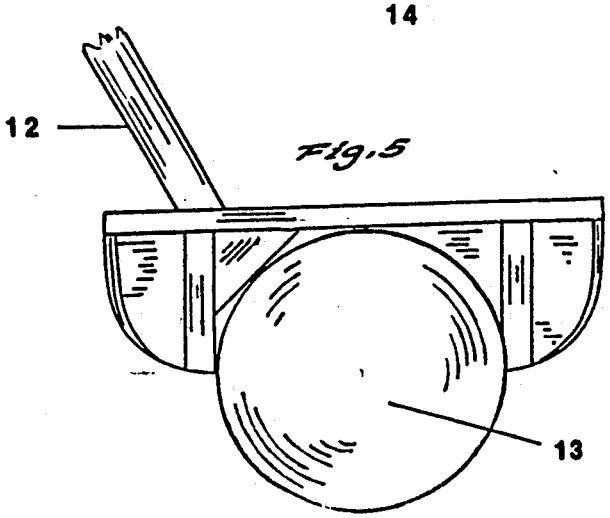
FIG. 5 show a back view with a golf ball wedged between the inside of the sides 7 and part of a shaft 12 to show the shaft position.

The sole 14, FIG. 4, is narrow and rounded to slide over the grass if the golfer should hit the grass.

Figure 3:
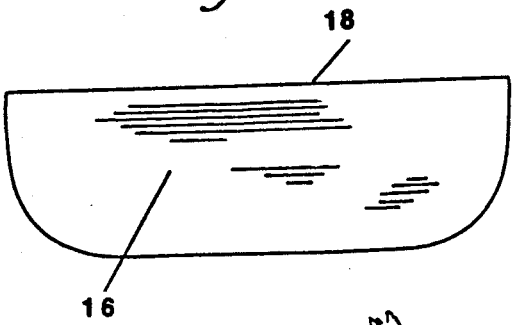
FIG. 3 is a front view of the putter head showing the flat top of the flange and shape of the face 16.

FIG. 3 shows the shape of the face 16 and the flat top of the flange.

The head is one piece solid cast made of materials commonly used in making putters.

The face is a flat surface, all edges are parallel, or rounded.

I claim:

1. A putter head comprising a blade having a front face including a sweet spot for striking a golf ball, a rear surface, a sole and weight distribution means including means for retrieving a golf ball, said retrieving means being defined by two substantially vertical, narrow walls, generally coextensive in height with that of said blade, on opposite sides of said sweet spot and extending rearward from said rear surface of said blade, the spaced apart distance between said walls being such that a golf ball to be retrieved can become wedged therebetween when the putter head is placed over a golf ball and pressure is applied downward, the bottom edges of said walls providing reduced resistance from grass while putting, said weight distribution means including a horizontal flange extending rearward from said blade, substantially perpendicular thereto, and generally coextensive with the upper edges of said blade and said parallel walls, whereby said flange and said walls provide weight centered directly behind the sweet spot to provide a solid feel and directional control in putting.

2. A putter head as recited in claim 1 including a sighting line of the upper surface of said flange and generally perpendicular to said striking face for lining up the putt with a target.

* * * * *